United States Patent [19]

Ruhe et al.

[11] 4,286,654

[45] Sep. 1, 1981

[54] HEAT EXCHANGER TUBE SUPPORTS

[75] Inventors: Anthony Ruhe, Fonthill; James H. D. Nickerson, St. Catharines, both of Canada

[73] Assignee: Foster Wheeler Limited, Ontario, Canada

[21] Appl. No.: 46,988

[22] Filed: Jun. 8, 1979

[30] Foreign Application Priority Data

Mar. 19, 1979 [CA] Canada ..... 323743

[51] Int. Cl.[3] ..... F28F 9/00

[52] U.S. Cl. ..... 165/172; 248/68 R

[58] Field of Search ..... 165/162, 172; 176/78; 248/68 R, 68 CB

[56] References Cited

U.S. PATENT DOCUMENTS

| | | | |
|---|---|---|---|
| 3,301,764 | 1/1967 | Timbs et al. | 176/78 |
| 3,637,008 | 1/1972 | Michel et al. | 165/162 |
| 3,720,259 | 3/1973 | Fritz et al. | 165/162 |
| 4,160,477 | 7/1979 | Roffler | 165/172 |

FOREIGN PATENT DOCUMENTS

| | | | |
|---|---|---|---|
| 488054 | 1/1976 | U.S.S.R. | 165/172 |

*Primary Examiner*—Sheldon Richter

*Attorney, Agent, or Firm*—Marvin A. Naigur; John E. Wilson; John J. Herguth, Jr.

[57] ABSTRACT

A heat exchanger having a number of heat exchange tubes and an improved tube support. The support comprises a plurality of strips which are identical and joined together so that the support engages each tube.

4 Claims, 2 Drawing Figures

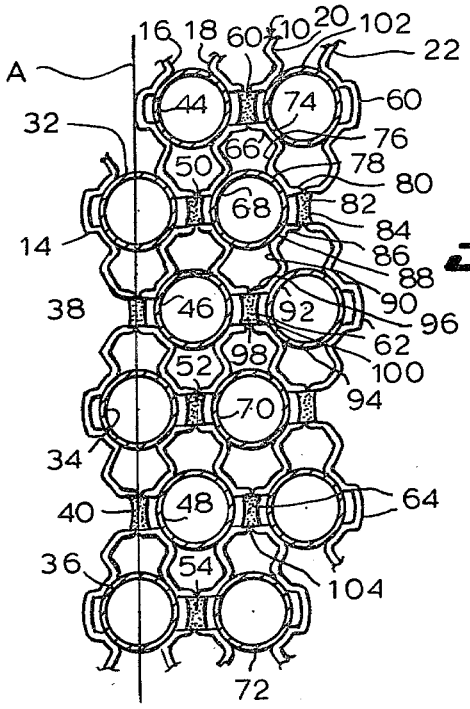
Fig. 1
Fig. 2
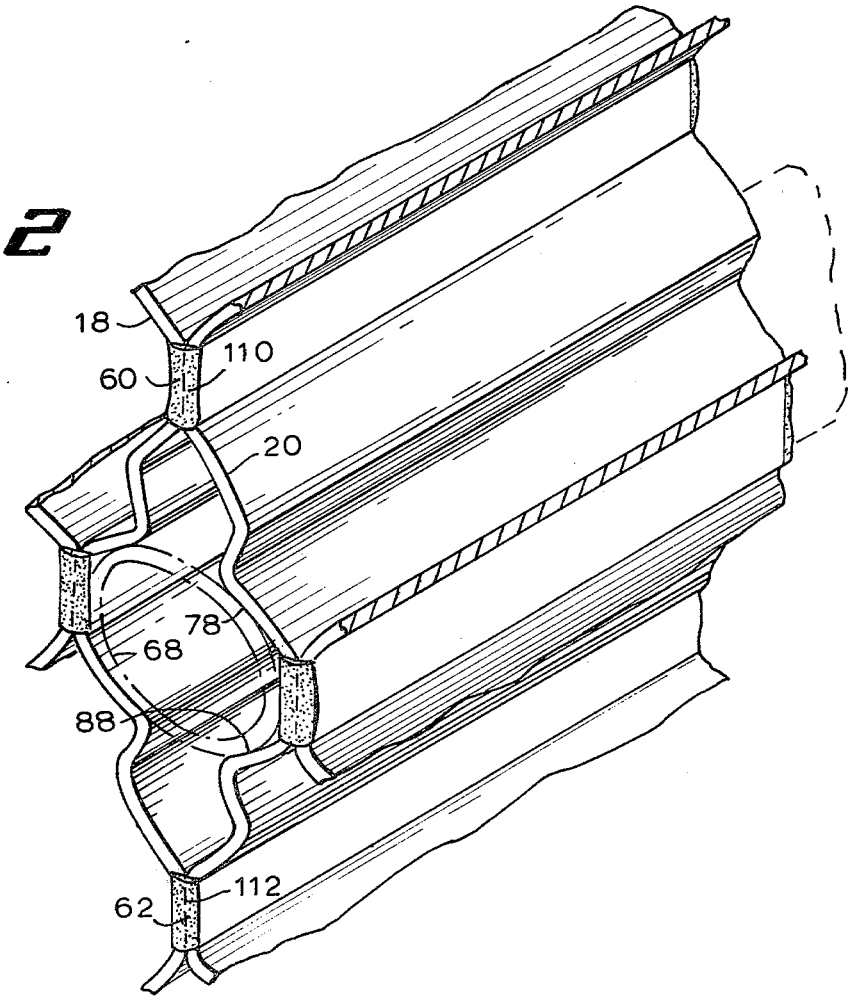

HEAT EXCHANGER TUBE SUPPORTS

BACKGROUND OF THE INVENTION

Heat exchangers have many industrial uses and are usually, if not always, a necessary component in facilities such as process plants, chemical process plants and manufacturing plants. Many heat exchangers place two fluids in indirect heat exchange, that is, the fluids exchange heat without contacting each other. In many such heat exchangers, one fluid is passed through a number of tubes over which another fluid is flowing. The two fluids exchange heat through the tube walls.

Although heat exchangers which employ a number of heat exchange tubes possibly constitute the most efficient type, they are not without their disadvantages. The movement of the fluids often create vibration and exert other forces on the tubes. In order to stabilize the tubes, they are usually provided with tube supports, that is, structure which extends between the tubes to support them. Tube supports can place a limit on the efficiency of the heat exchanger in that they create a resistance to the flow of fluid passing over the tubes and often decreases the effective heat exchange surface. Further, tube supports can create crevices around the tubes which can result in corrosion.

The degree to which any problem created by tube supports exist depends on a number of factors, for example, in heat exchangers used in Nuclear Power Plants the tubes must be supported to withstand a considerable seismic load. Further, the tubes must be supported against the dynamic loads experienced during shipment to prevent excessive straining.

SUMMARY OF THE INVENTION

It is an object of the present invention to overcome drawbacks found in the prior art such as those discussed above. Accordingly, a heat exchanger having a number of heat exchange tubes is provided with a tube support comprising a plurality of strips, each of the strips having a plurality of equidistant first contact locations in one plane, a plurality of first portions extending in a given direction parallel to the plane to an adjacent first contact location to one of a plurality of second contact locations, a plurality of second portions each extending in said direction from an adjacent second contact location and toward the plane to one of a plurality of third contact locations, a plurality of third portions each extending in said direction from an adjacent third contact location away from said plane to one of a plurality of fourth locations, a plurality of fourth portions each extending in said direction toward said plane to one of a plurality of fifth contact locations, a plurality of fifth portions each extending from an adjacent fifth contact location in said direction toward said plane to one of a plurality of sixth contact locations and a plurality of sixth portions each extending from one of said sixth locations to another of said first locations, said fourth contact locations lying equidistant along another plane and joined to the first contact locations of an adjacent strip, the second contact locations engaging the surface of tubes extending through said other plane, the third and fifth contact locations engaging a tube extending through said one plane and the sixth contact location engaging the surface of another tube extending through the other plane.

BRIEF DESCRIPTION OF THE DRAWINGS

FIG. 1 is a top view partly in section showing a tube support made in accordance with the present invention with associated heat exchange tubes; and FIG. 2 is a view in perspective and partly in section showing portions of the tube support of FIG. 1.

DETAILED DESCRIPTION OF THE PREFERRED EMBODIMENTS

The section of tubes supports shown in FIG. 1 indicated generally as 10 is made up of a number of strips, 14, 16, 18, 20 and 22. Each of the strips passes on one side of a plane extending through the center of a row of heat exchange tubes. For example, the strip 14 lies on one side of a plane "A" which passes through the center of tubes 32, 34 and 36. The strip 16 is positioned on the other side of the plane "A". The strips 14 and 16 are joined together at welds 38 and 40. The strip 16 is identical to strip 14 except that it is turned over on itself so that both strips are symmetric with respect to the plane "A". The strip 16 lies on the side of a plane passing through the center of tubes 44, 46 and 48 and is joined at welds 50, 52 and 54 to a strip 18 which lies on the other side of that plane. This relationship of adjacent strips is continued across the tube support 10.

The structure of the strip 20 will be explained in detail, but it should be appreciated that each of the strips is of essentially the same configuration. The strip 20 as the other strips has a number of equidistant first contact locations 60, 62 and 64 at which the strip 20 is welded to locations on the adjacent strip 18. The strip 20 has segments between each of the first contact locations which are identical but only one will be explained for the sake of brevity. Adjacent to the first contact location 60 is a first portion 66 which extends away from the plane which extends through the center of tubes 68, 70 and 72. The portion 66 extends in a direction along that plane and away from that plane to a second contact location 74. A second portion 76 extends in the same direction along the plane and toward the plane until it merges with an integral third contact location 78 at which the strip 20 engages the tube 68. Thereafter, a third portion 80 extends along the said direction but away from the plane to a fourth contact location 82 where the strip 20 is welded at 84 to the strip 22.

Thereafter, a fourth portion 86 extends in said direction and towards said plane to a fifth contact location 88 where the strip 20 engages the tube 68. A fifth portion 90 extends in the previously mentioned direction and away from the plane to a sixth contact location 92 at which the strip 20 contacts a tube 94. A sixth portion 96 extends to a contact location 98 which lies in the same plane as does the first contact location 60. A weld 100 at the contact location 98 secures the strip 20 to the strip 18.

Thus, the contact locations 60 and 98 lie in the same plane as do the contact locations 74 and 92. It should be noted that contact locations 78 and 88 also lie in the same plane. The fourth contact location 82 lies in a plane extending through a tube 94 and a tube 102 which is engaged by the second contact location 74. The fourth contact location 82 lies in the same plane as contact location 104 on the strip 20.

FIG. 2 shows a small portion of the tube support shown in FIG. 1. it shows strips 18 and 20 between the contact locations 60 and 62. The strip 18 has corresponding contact locations 110 and 112. It can be seen from FIG. 2 that the contact locations on each of the strips 18 and 20 which would engage a tube comprise segments which present an elongated narrow surface running parallel to the longitudinal axis of the tube. This design has been found to be less damaging for a given tube loading than when other designs such as point or line contact are employed.

The present tube support provides a high degree of porosity, and consequently, there is comparatively little resistance to flow of a fluid passing parallel to the tubes. The result is comparatively little pressure drop and a concomitant increase in efficiency. Since very little tube area is covered by the support, the effective heat exchange area of the tubes is not substantially adversely effected. In other words, a high degree of "wetness" of the tubes is attained. This feature has been found to reduce the risk of tube corrosion.

The design permits the use of longitudinal fluid flow, that is, flow parallel to the tubes. In other designs, tube supports necessitate lateral flow at certain locations within the heat exchanger. The present invention provides for a heat exchanger in which full counterflow heat exchange over substantially all of the heat surface is possible.

The present invention also provides a tube support which can be made from any number of materials best suited for the purpose and which can be produced from any of a number of available metals and can be formed from identical strips of metal. It has been found to be extremely strong whether subjected to tension, compression, sheer or bending force and to exhibit superior fatigue properties.

The foregoing describes an embodiment of the present invention which is presently preferred, other embodiments being possible without exceeding the scope of the invention as defined in the following claims.

What is claimed is:

1. In a heat exchanger a number of heat exchange tubes having a tube support comprising:

a plurality of strips, each of said strips having a plurality of equidistant first contact locations in one plane, a plurality of first portions extending in a given direction away from said plane from an adjacent first contact location to one of a plurality of second contact locations, a plurality of second portions, each extending in another direction from an adjacent second contact location and toward said one plane to one of a plurality of third contact locations, a plurality of third portions, each extending in said direction from an adjacent third contact location to one of a plurality of fourth contact locations; a plurality of fourth portions, each extending from an adjacent fourth contact location in said other direction and toward said plane to one of a plurality of fifth contact locations, a plurality of fifth portions each extending from one of said fifth contact locations in said direction and away from said plane to one of a plurality of sixth contact locations, a plurality of sixth portions each extending away from an adjacent sixth contact location in said other direction to another of said first locations, said fourth contact locations lying equidistant along another plane and joined to the first locations of an adjacent strip; the second contact location engaging over the width of the surface of said strip the surface of a tube extending through said other plane; the third and fifth contact locations engaging over the width of the surface of said strip a tube extending through said one plane and the sixth contact location engaging over the width of the surface of said strip the surface of another tube extending through the other plane.

2. The invention defined in claim 1 wherein said first locations are joined to the fourth locations of adjacent strips by welding.

3. The invention defined in claim 2 wherein said portions are curved to smoothly join said locations.

4. The invention defined in claim 2 wherein said strips are of equal width with each welded to the other over the entire width of each.

* * * * *